United States Patent [19]

Nakane et al.

[11] 4,080,057

[45] Mar. 21, 1978

[54] APPARATUS FOR ADJUSTING EXPOSURE IN ELECTROSTATIC COPIER

[75] Inventors: Masami Nakane, Toyokawa; Koji Imaizumi, Aichi, both of Japan

[73] Assignee: Minolta Camera Kabushiki Kaisha, Osaka, Japan

[21] Appl. No.: 671,941

[22] Filed: Mar. 30, 1976

[30] Foreign Application Priority Data

Apr. 9, 1975 Japan ..... 50-48438[U]

[51] Int. Cl.[2] ..... G03G 15/00

[52] U.S. Cl. ..... 355/11; 355/3 R; 355/71

[58] Field of Search ..... 355/11, 66, 71, 3 R

[56] References Cited

U.S. PATENT DOCUMENTS

| | | | |
|---|---|---|---|
| 2,552,990 | 5/1951 | McKay | 355/66 X |
| 3,309,973 | 3/1967 | Engler | 355/71 X |
| 3,469,916 | 9/1969 | Sloan | 355/66 X |
| 3,606,535 | 9/1971 | Koizumi | 355/66 |
| 3,609,037 | 9/1971 | Suzuki | 355/66 |
| 3,963,342 | 6/1976 | Stark et al. | 355/11 X |

*Primary Examiner*—Fred L. Braun

*Attorney, Agent, or Firm*—Watson, Cole, Grindle & Watson

[57] ABSTRACT

An apparatus is provided for adjusting the exposure of the photoconductive member of an electrostatic copier, which permits fine adjustment of the exposure of the photoconductive member by providing a shade for the partial control of the light path for exposure, thereby effecting an error adjustment of the photoconductive member, the optical system, the projection lamp, etc., separately from the main exposure value control system.

5 Claims, 7 Drawing Figures

APPARATUS FOR ADJUSTING EXPOSURE IN ELECTROSTATIC COPIER

BACKGROUND OF THE INVENTION

This invention relates to an exposure value control apparatus designed to prevent uneven exposure in an electrostatic copier of the slit exposure type.

In the conventional photocopiers having means for lightening the original by adjusting the projection lamp to thereby lighten the image of the original to be copied, which image is reflected and cast onto a photoconductive member after which the photoconductive member is exposed, it is difficult to assure that the light will evenly reach the photoconductive member. For example, the reflected lighted image generally results in being brighter at the central portion thereof than at its ends, as the light reaching the photoconductive member depends on the properties of the lens of the optical system.

For the purpose of preventing uneven exposure, the conventional exposure control system, designed to adjust the brightness of the image of the original has blades which are so shaped as to cut into the light path more at the central portion, or a masking is disposed in front of the projection lamp so that the loss of light at the ends might be compensated for by adjusting its position.

With these electrostatic copiers, the distribution of the exposure value varies from one to another depending on the comprehensive properties of their optical systems, photoconductive members, exposure lamps, etc.. This is attributable to uneven properties between the components of one copier and their counterparts of another. Therefore, the exposure must be adjusted when manufacturing each copier.

Accordingly, the aforementioned conventional exposure control system has been found ineffective because of its inability to provide a fine adjustment of the exposure which is different from one copier to another.

SUMMARY OF THE INVENTION

The primary object of this invention is therefore to provide an apparatus for adjusting exposure in an electrostatic copier so that differences in the distribution of the exposure value among the electrostatic copiers may be easily and effectively adjusted.

Another object of this invention is to provide an apparatus for adjusting exposure in an electrostatic copier, so as to partially cut the light path, the present apparatus being separate from the main control system designed to control the brightness of the image of the original.

A further object of this invention is to provide an apparatus for adjusting exposure in an electrostatic copier, which is of a simple and highly economical construction including an exposure adjusting panel capable of being moved toward and away from the light path at predetermined amounts along its length by means of a plurality of adjustment screws.

Other objects and advantages of this invention will become more apparent from the hereinafter detailed description of the invention when taken in conjunction with the accompanying drawings.

In carrying out the above objects of the invention, an exposure adjusting member is provided as being capable of movement toward and away from the light path leading to the photoconductive member from the projection lamp through the optical system including the lens, a plurality of elements being disposed along the length of the exposure adjusting member for adjusting same to partially cut into the light path. Accordingly, adjustments for the differences in the distribution of the exposure value among different copiers can be effectively made by the exposure adjusting member according to the invention.

BRIEF DESCRIPTION OF THE DRAWINGS

FIG. 2(*b*) is a view similar to FIG. 2(*a*) illustrating the exposure adjusting apparatus in a condition capable of partially cutting the light path.

DETAILED DESCRIPTION OF THE INVENTION

Figure 4:
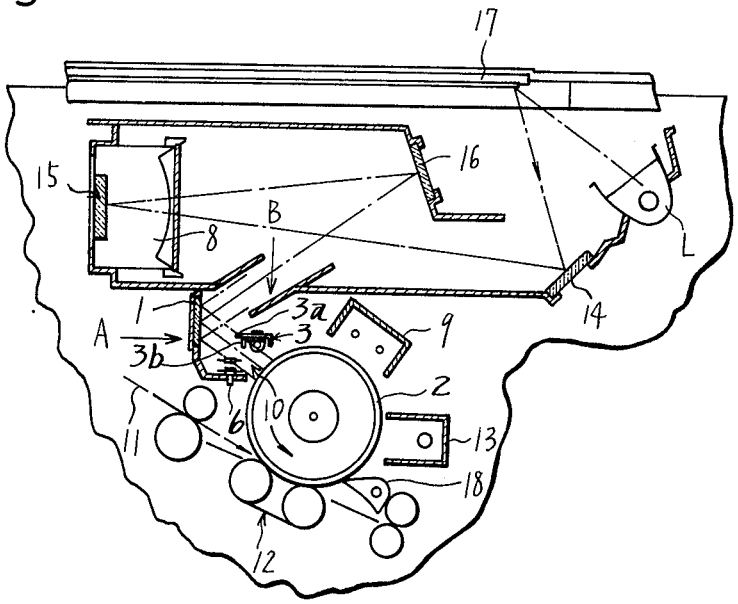
FIG. 4 is a vertical cross-sectional view, partly broken away, of an electrostatic copier in which the exposure adjusting apparatus of the invention may be incorporated.

Referring initially to FIG. 4, the electrostatic copier, in which the exposure adjusting apparatus of the invention may be incorporated, includes a rotatable photoconductive member 2 adapted to rotate to sequentially pass a plurality of processing stations.

These processing stations in the path of the movement of the photoconductive member 2 include a charging station whereat the surface of the photoconductive member 2 is electrostatically charged with a corona charger 9, an exposure station 10 whereat image of the original to be copied is projected onto the photoconductive member 2 to form an electrostatic latent image, an image transfer station whereat the electrostatic latent image formed on the photoconductive member 2 is transferred onto a copying paper 11 by a transfer means 12, the detail of which may be referred to U.S. Pat. No. 3,824,012 assigned to same assignee, and an erasing station whereat residual charges on the photoconductive member 2 is erased with an eraser 13.

In the upper portion of the photoconductive member 2, there is provided an optical system including a light source L, a plurality of reflector mirrors 1, 14, 15, 16 and a lens 8. Positioned above the optical system is a reciprocatingly movable platform 17 on which the original to be copied is placed.

Accordingly the image of the original is scanned as the platform 17 is moved and projected onto the rotating photoconductive member 2 through the exposure station by said reflectors 14, 15, 16, 1 and the lens 8 following the path illustrated by phantom lines. The electrostatic latent image formed on the photoconductive member 2 is then transferred onto the copying paper 11 by the transfer means 12 and subsequently separated from the photoconductive member by a separating means 18 in contact with the photoconductive surface. The copying paper thereafter is developed and fixed in a known manner to become a final copy.

Figure 1:
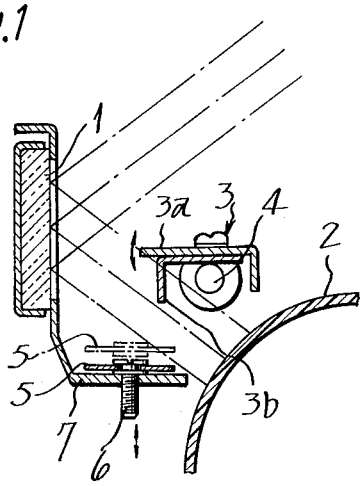
FIG. 1 is a vertical cross-sectional view illustrating an apparatus for adjusting the exposure value according to the invention.
Figure 5:
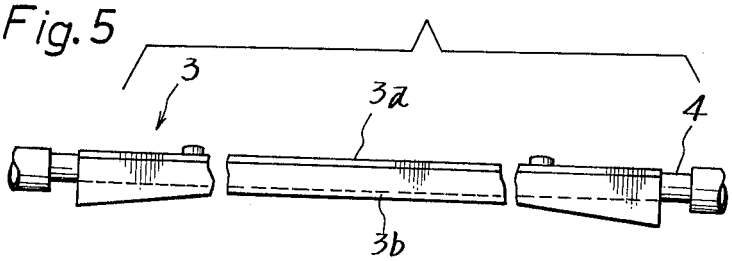
FIGS. 5 and 6 are front and top plan views of an exposure control apparatus viewed from directions A and B respectively.
Figure 6:
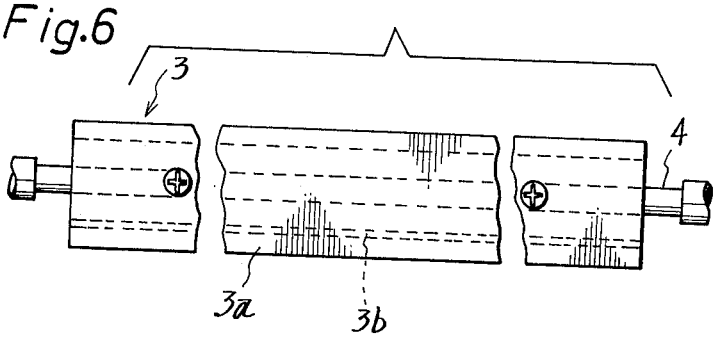

At the exposure station 10 through which the image of the original is projected onto the photoconductive member, there is provided an exposure control apparatus 3 between the reflector 1 and the photoconductive member 2 as shown in FIGS. 1, 5 and 6 for primarily controlling the light reaching the photoconductive member 2. Exposure control apparatus 3 is mounted on a spindle 4 which is rotatable from outside the copier and includes blades 3*a* and 3*b*, the tips of which are made mutually rectangular. As spindle 4 is rotated in the direction of the double arrow in FIG. 1, the tip of either blade or the tips of both blades cut or interfere with the path of light. Various shapes may be introduced for the tip of both blades to compensate for the difference in the amount of exposure between the center and the ends of the path of light.

One of the examples is shown in FIGS. 5 and 6 wherein the tip of blade 3*a* is shaped straight parallel to the spindle 4 and the tip of blade 3*b* is shaped to extrude gradually from the middle toward both side ends with the middle portion most deeply cut. Such exposure control apparatus is particularly suitable for the electrostatic copier of FIG. 4 or other copiers employing a drum type photoconductive member having a small diameter (e.g., 50 to 100mm) since the tip of blade 3*b* so shaped would prevent the lowering of image resolution at both side ends of the photoconductive drum 2 caused by the sharp curvature of the drum.

Accordingly, when the original has comparatively strong contrast between the bright and dark portions thereof, the exposure control apparatus 3 can be rotated in such a position as to form a narrow straight rectangular slit by the tip of the first blade 3*a*, in which case, the image focused on the photoconductive surface 2 is quite narrow that the distortion of the focused image scarecely occurs, with the image being quite sharp from edge to edge. On the other hand, when the original has comparatively soft contrast between the bright and dark portions thereof, the exposure control apparatus 3 may be rotated in such a manner as to form a slit width at its central portion by the tip of the second blade 3*b*, in which case, the image formed on the photoconductive surface 2 is narrowed at its opposite ends and wide in its central portion. In this case, the distortion of the focused image, due to sharp curvature of the photoconductive drum, can be decreased by narrowing the slit width at opposite end portions thereof, which results in sharp focused image on the photoreceptor surface 2*a*. When said contrast of the original is normal, the slit control member 3 may be turned halfway to form a slit in which the central portion thereof is formed by the first blade 3*a* and opposite end portions thereof is formed by the second blade 3*b*.

In this manner, an amount of exposure reaching the photoconductive member 2 is primarily controlled by said exposure control apparatus 3. In addition, a masking means or other suitable means may be disposed in front of the lamp L to compensate for the loss of light at the side ends of the photoconductive member.

In other types of copiers not confronting the lowering of image resolution at side ends of the drum due to its sharp curvature the exposure control apparatus such as that disclosed by U.S. Pat. No. 3,469,916 may be employed. In this, the tip of blade is so shaped to intrude from the middle to side ends to compensate for the loss of light in the sides.

However, these exposure control apparatuses cannot be adjusted to prevent differences in the distribution of the exposure value of copiers, since such control apparatuses are designed to control the brightness of the image of the original. In other words, the exposure control apparatus can only control the slit width and cannot control or adjust the differences in the distribution of the exposure value within the slit width adjusted by said exposure control apparatus. To be more specific, a reproduced copy will have the differences in the distribution of light and dark areas, or blurred stripped pattern running parallel to the moving direction of the photoconductive member even with the exposure control apparatus adjusted. Since such phenomenon is attributable mainly to uneven properties of optical system, exposure lamp, photoconductive member, etc., which differ from one copier to another, some means must be provided to compensate therefor other than said exposure control apparatus. This problem is solved by the present invention by additionally providing an exposure adjusting member as including an elongated and flexible exposure adjusting panel 5 disposed adjacent the light path between reflector 1 and photoconductive member 2.

Figure 3:
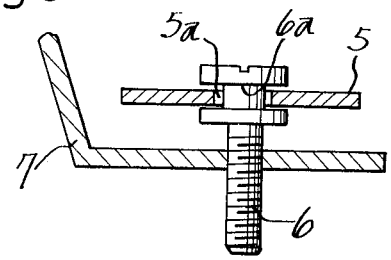
FIG. 3 is a vertical cross-sectional view in more detail of one of the adjustment screws provided for movement of an exposure adjusting panel of the apparatus for adjusting the exposure value according to the invention.
Figure 2A:
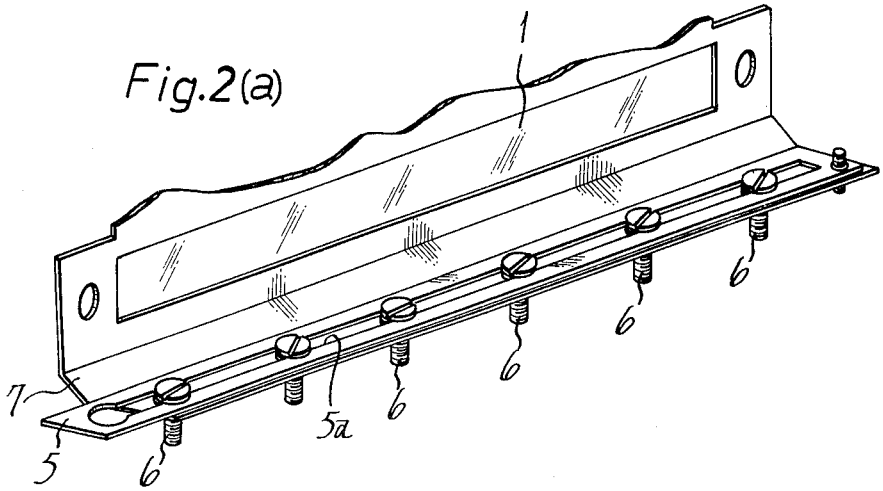
FIG. 2(*a*) is a perspective view illustrating the apparatus for adjusting the exposure value according to the invention, the apparatus being in a condition incapable of cutting the light path.
Figure 2B:
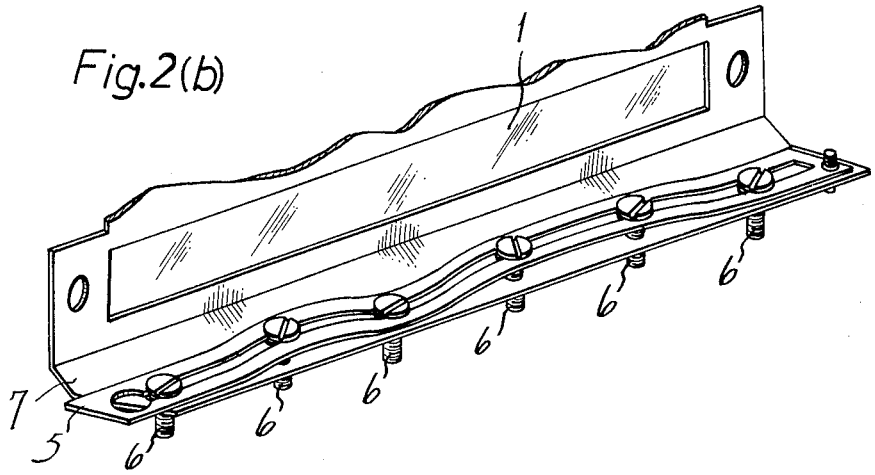

As illustrated in FIGS. 2 and 3, exposure adjusting panel 5 is mounted on a member 7 located below reflector 1 and is held in place by means of a plurality of spaced screws 6 which are threadedly engaged in member 7. A circular groove 6*a* is defined beneath the head of each screw, and the opposite edges of an elongated slot 5*a* of the exposure adjusting panel extend into grooves 6*a* of the screws as clearly shown in FIG. 3. Accordingly, movement of selected ones of the independently adjustable screws toward the light path effects a corresponding movement of panel 5.

FIG. 2(*a*) shows the condition in which exposure adjusting panel 5 lies flat against the horizontal flange of member 7 without coming into the light path as shown in solid outline in FIG. 1. The screws 6 in this condition are of course in their downwardly tightened position as shown.

FIG. 2(*b*) illustrates the condition in which exposure adjusting panel 5 is partially brought into the light path through the operation of screws 6 as selected ones of them are adjusted for movement toward the light path so as to accordingly adjust panel 5 partially along its length toward the light path as further shown in phantom outline in FIG. 1. Exposure adjusting panel 5 is of an elastic material such as ribbon steel or a phosphor bronze plate so that it may follow the moves of screws 6 without difficulty. The number of screws 6, and the position, size and shape of exposure adjusting panel 5 are variable depending on the need.

Exposure adjusting panel 5 can partially cut the light path and makes possible the partial or fine adjustment of exposure by reason of its movements in accordance with the up and down movements of screws 6. In this manner, a perfect adjustment for the amount of exposure is carried out in combination with the aforedescribed exposure control apparatus 3 so that a sharp contrast image without any variation in the distribution of exposure value can be obtained.

As is apparent from the foregoing, the apparatus for adjusting exposure according to this invention is of a simple construction and functional and of economical superiority in view of the partial or fine adjustment of the exposure made possible with the screws capable of moving toward and away from the light path, and also with the flexible exposure adjusting panel held by the screws so as to follow their movement, and that differences in the distribution of the exposure value by copiers can be adjusted.

It should be noted that the exposure adjusting apparatus according to the present invention may be employed in any slit exposure type copier in combination with any suitable main exposure apparatus.

While the preferred embodiment of this invention has been described and illustrated, numerous alterations, omissions and additions may be effected without departing from the spirit of the invention itself.

What is claimed is:

1. In an electrostatic copier apparatus of the slit exposure image type having a photoconductive member and an optical system including a reflector for reflecting a path of light of an image to be copied from an original onto said photoconductive member, said copier further having a main exposure control means for controlling brightness of the image; an exposure adjusting member mounted adjacent the path of light and including a plurality of elements for partially moving said exposure adjusting member into and out of the path of light so as to partially cut into the light path for adjusting the exposure of the photoconductive member, each of said elements being independently adjustable so as to control the amount of adjustment of said exposure adjusting member; and said exposure adjusting member being independent of said main exposure control means for independently adjusting the exposure of said photoconductive member.

2. In the copier apparatus according to claim 1, wherein said exposure adjusting member is disposed between said reflector and said photoconductive member and is separate from said main exposure control means for separately adjusting the exposure of said photoconductive member.

3. In the copier apparatus according to claim 1, wherein said exposure adjusting member further includes a flexible elongated panel having a longitudinal elongated slot therein, said elements comprising a plurality of threaded screw members spaced along said panel for mounting said exposure adjusting member in place and for moving said panel into and out of the light path upon adjustment of said screw members toward and away from the light path, each of said screw members having a circular groove, and opposite edges of said slot extending into the groove of each said screw member so that, upon independent adjustment of said screw members to predetermined and different extents toward and away from the light path, said panel is accordingly moved into and out of the light path for partially cutting into the light path whereby the exposure of the photoconductive member is adjusted.

4. In the copier apparatus according to claim 3, wherein said exposure adjusting member is disposed between said reflector and said photoconductive member and is separate from said main exposure control means for separately adjusting the exposure of said photoconductive member.

5. In an electrostatic copier apparatus of the slit exposure image transfer type having a photoconductive member of a predetermined width and movably disposed in the copier apparatus, and an exposure system including a projection lamp and an optical system having a reflector member for reflecting a path of light of an image to be copied from an original onto said photoconductive member, said copier further having a main exposure control means for variably controlling the amount of the light to the photoconductive member; an exposure adjusting member mounted adjacent the path of light, and having a length substantially corresponding to the width of said photoconductive member; said exposure adjusting member including a plurality of elements for partially moving said exposure adjusting member into and out of the path of light so as to partially cut into the light path for precisely adjusting the exposure of the photoconductive member, each of said elements being independently and precisely adjustable so as to control the amount of adjustment of said exposure adjusting member; and said exposure adjusting member being independent of said main exposure control means for independently adjusting the exposure of said photoconductive member.

* * * * *